US010954614B2

(12) United States Patent
Giorgini

(10) Patent No.: US 10,954,614 B2
(45) Date of Patent: Mar. 23, 2021

(54) GARMENT WITH ELASTIC INSERTS PRODUCED USING CIRCULAR MACHINES

(71) Applicant: TRERÈ INNOVATION, Brescia (IT)

(72) Inventor: Fabio Giorgini, Monticelli Brusati (IT)

(73) Assignee: TRERÈ INNOVATION, Brescia (IT)

( * ) Notice: Subject to any disclaimer, the term of this patent is extended or adjusted under 35 U.S.C. 154(b) by 674 days.

(21) Appl. No.: 15/560,292

(22) PCT Filed: Mar. 22, 2016

(86) PCT No.: PCT/IT2016/000070
§ 371 (c)(1),
(2) Date: Sep. 21, 2017

(87) PCT Pub. No.: WO2016/157227
PCT Pub. Date: Oct. 6, 2016

(65) Prior Publication Data

US 2018/0051401 A1 Feb. 22, 2018

(30) Foreign Application Priority Data

Mar. 27, 2015 (IT) ..... RM2015A000129

(51) Int. Cl.
*D04B 1/26* (2006.01)
*A41B 11/00* (2006.01)
(Continued)

(52) U.S. Cl.
CPC ..... *D04B 1/265* (2013.01); *A41B 1/08* (2013.01); *A41B 11/003* (2013.01); *A41B 11/02* (2013.01);
(Continued)

(58) Field of Classification Search
CPC ... D04B 1/12; D04B 1/18; D04B 1/24; D04B 1/243; D04B 1/246; D04B 1/265; A61F 13/08; A41D 11/003
See application file for complete search history.

(56) References Cited

U.S. PATENT DOCUMENTS 2,050,535 A * 8/1936 Martel ..... D04B 1/18 66/178 R
2,206,808 A * 7/1940 Davis ..... D04B 1/18 66/9 R
(Continued)

FOREIGN PATENT DOCUMENTS

GB 951 610 3/1964
WO 2007/065459 6/2007

OTHER PUBLICATIONS

International Search Report dated Jun. 27, 2016 in International Application No. PCT/IT2016/000070.

*Primary Examiner* — Danny Worrell
(74) *Attorney, Agent, or Firm* — Wenderoth, Lind & Ponack, L.L.P.

(57) ABSTRACT

The present invention relates to a garment with elastic inserts produced on circular machines of the type comprising elasticised sectors (3) and elasticised zones obtained by working in a further elastomeric yarn—in addition to the ground yarn and the reinforcing yarn normally used—and actually knitting the yarns so as to create machined portions, both horizontally and obliquely, which result in well-defined and demarcated zones which provide greater compression than the knitted stitches on the same row, thereby providing—within the elasticised sectors (3)—a greater compression value than outside the sector on the same row of knitted stitches. The elasticised sectors (3) are designed portions which create ornamental figures or banding with specific compression which can provide support, contribute to the
(Continued)

stimulation of blood circulation, reduce fatigue, and render movement safer and more supported, when properly positioned and sized.

12 Claims, 5 Drawing Sheets

(51) Int. Cl.

| | |
|---|---|
| ***A41D 13/00*** | (2006.01) |
| ***A41D 17/02*** | (2006.01) |
| ***D04B 1/24*** | (2006.01) |
| ***D04B 1/12*** | (2006.01) |
| ***A41D 31/18*** | (2019.01) |
| ***D04B 1/18*** | (2006.01) |
| ***A41B 1/08*** | (2006.01) |
| ***A41B 11/02*** | (2006.01) |
| ***A41D 1/08*** | (2018.01) |
| ***A41D 13/05*** | (2006.01) |
| ***A41D 13/06*** | (2006.01) |
| ***A61H 1/00*** | (2006.01) |

(52) U.S. Cl.

CPC ..... *A41D 1/08* (2013.01); *A41D 13/0015* (2013.01); *A41D 13/0543* (2013.01); *A41D 13/065* (2013.01); *A41D 17/02* (2013.01); *A41D 31/185* (2019.02); *A61H 1/006* (2013.01); *D04B 1/12* (2013.01); *D04B 1/18* (2013.01); *D04B 1/24* (2013.01); *D04B 1/243* (2013.01); *D04B 1/246* (2013.01); *A41B 2400/322* (2013.01); *A41B 2500/10* (2013.01); *A41D 2400/322* (2013.01); *A41D 2500/10* (2013.01); *A41D 2600/10* (2013.01); *A41D 2600/20* (2013.01); *A61H 2201/164* (2013.01); *A61H 2201/165* (2013.01); *A61H 2201/1619* (2013.01); *A61H 2201/1635* (2013.01); *A61H 2205/102* (2013.01); *A61H 2205/12* (2013.01); *A61H 2209/00* (2013.01)

(56) References Cited

U.S. PATENT DOCUMENTS 3,290,904 A * 12/1966 Snyder ..... D04B 1/265 66/200
4,502,301 A * 3/1985 Swallow ..... A61F 13/08 602/62
4,862,523 A * 9/1989 Lipov ..... A41B 11/14 2/409
5,201,074 A * 4/1993 Dicker ..... A41D 13/0015 2/227
5,465,594 A * 11/1995 Imboden ..... D04B 1/243 66/177
5,787,732 A * 8/1998 Perron ..... D04B 1/243 2/401
5,819,322 A * 10/1998 Dicker ..... A41D 13/0015 2/456
5,855,123 A 1/1999 Albright
5,857,947 A * 1/1999 Dicker ..... A63B 21/00185 2/69.5
7,434,423 B1 * 10/2008 Reid, Jr. ..... A61F 13/08 66/178 A
7,546,751 B2 * 6/2009 Lutz ..... D04B 1/18 66/177
7,895,863 B2 * 3/2011 Smith ..... D04B 1/18 66/172 E
8,317,736 B2 * 11/2012 Virkus ..... A61F 13/08 2/240
8,533,864 B1 * 9/2013 Kostrzewski ..... A41D 13/0015 2/69
8,973,411 B2 * 3/2015 Gaither ..... A61F 13/08 66/182
9,777,413 B2 * 10/2017 Messier ..... D04B 9/52
2003/0230121 A1 * 12/2003 Yokoyama ..... A41B 11/003 66/178 A
2007/0113593 A1 * 5/2007 Jeong ..... D04B 1/02 66/180
2007/0149093 A1 6/2007 Lutz
2008/0155731 A1 * 7/2008 Kasahara ..... D04B 1/265 2/240
2009/0165190 A1 * 7/2009 Araki ..... D04B 1/02 2/240
2009/0276939 A1 * 11/2009 Sho ..... D04B 1/12 2/239
2011/0196416 A1 * 8/2011 Lambertz ..... A61F 13/08 606/201
2011/0314591 A1 * 12/2011 Mitsuno ..... A61F 13/08 2/239
2012/0024014 A1 * 2/2012 Fukui ..... D04B 15/06 66/171
2014/0053610 A1 * 2/2014 Fukui ..... A41B 11/003 66/183
2015/0245951 A1 * 9/2015 Convert ..... D04B 1/18 66/178 A
2018/0353345 A1 * 12/2018 Sasaki ..... D04B 1/26

* cited by examiner

GARMENT WITH ELASTIC INSERTS PRODUCED USING CIRCULAR MACHINES

TECHNICAL FIELD

The present invention relates to a garment with elastic inserts produced using circular machines which are particularly suitable to create differentiated zones with specific, localised compression which provides, for example, support, stimulation of blood circulation, massage to stimulate musculature, shock-absorbing protection, etc.

BACKGROUND ART

At present, for products produced using circular machines, such as socks and underwear, the conformation of the knitting is a direct consequence of the spiraloid construction of the article. The construction is comparable with the thread of a screw as due to the formation of the knitting, which is carried out around a circumference and is repeated at each turn of the cylinder, superimposing a succession of rows of knitting, always in the same direction. The spirality of the knitted fabric results in the fact that the yarns used to create an ornamental pattern or other layout also follow the spiral machining setting, starting the knitting action with a row of knitting at a given point and at a specified number of turns of the cylinder and terminating one or more turns later, and—therefore—always with the design developing in a horizontal direction. In particular, when one wishes to create a design which runs downwards, in an oblique fashion, along the semi-finished item be that a sock or a top, it is necessary to insert a further ground yarn and then, immediately after a certain number of points, cut such yarn using an appropriate device in order to achieve the desired design width and endeavouring to prevent slip-off, so as to proceed consistently therewith in the subsequent rows.

The system just illustrated for circular machines is practicable with non-elasticised yarns or with yarns with a low degree of elastication, therefore such types of machining strictly preclude elastomeric yarns or compound yarns, including therein those with only a percentage of elastomer. Unfortunately, such yarns are the only ones which allow a significant compression effect to be achieved, due to the intrinsic elasticity thereof, in addition to that provided by the knitting itself, and—for this reason—such yarns are widely used in both the sports field and the medical field.

The difficulty in the use of elastomeric yarns is due to the fact that, once knitted, the yarn—by its very nature—tends to come out of the knitting, since when cut, the yarn shrinks backwards, in the insertion direction, losing effectiveness and, consequently, fraying occurs, which is aesthetically displeasing and makes the presence of the elastic yarn less effective since the yarn loses grip substantially.

As is known, at present, elastic yarn is used as the ground yarn or as a textured yarn in order to create elasticity and compression and when there is a need to lend the article greater compression, one simply tightens, i.e. tensions, the yarn further. Such method, however, requires the presence of elastic yarn throughout the knitted fabric.

In particular, in socks, but also in garments such as tops or leggings, an elastic "banding" effect is achieved by means of toweling processing, which means that such insert is voluminous and can be uncomfortable, and furthermore still does not offer adequate compression due to the thickness thereof, which prevents proper tension, thereby limiting the compression effect. Moreover, in some types of socks a "banding" effect is produced, but solely within a designed area which features different machining in solely visual terms, since it does not correspond to a different structure in the fabric with a different compression and/or grip capacity. Such area is solely a psychological aid, but not a real, effective one.

In addition to everything illustrated so far, there is a demand expressed by the market for—for example—a sock which features a knitted fabric with a slim, flat knit which, at the same time, is capable of providing compression in well defined zones and protection in particular zones.

As it is known, nowadays, there is a lot of interest among users in clothes and accessories which are comfortable, practical, functional, aesthetically pleasing, and flexible in terms of the use thereof.

Indeed, it is a known fact, for example, that sportsmen and women are particularly demanding and careful about their choices when it comes to the clothing and accessories they use for their sporting activities, which means they refuse to accept compromises such as garments which do not meet up to their expectations and needs, and which even sometimes wrongfully heighten expectations.

Disclosure of Invention

The aim of the present invention is essentially to solve the problems of the commonly known technique, overcoming the drawbacks described above by means of a garment with elastic inserts produced using circular machines which features a design with an elastomer yarn in an oblique—and likewise—horizontal direction and, in any case, in limited, predefined zones.

A second aim of the present invention is to produce a garment with elastic inserts produced using circular machines, the said inserts being able to adapt perfectly to the body's morphology without an uncomfortable thickness, in addition to forming precise stretches of greater compression with respect to the knitting present on the same row.

A further aim of the present invention is to produce a garment with elastic inserts produced using circular machines able to allow the user to obtain stimulation of the blood circulation, a massaging effect, support, and remarkable comfort when worn.

A further aim of the present invention is to produce a garment with elastic inserts produced using circular machines, the said inserts featuring suitable elastic bands or elastic zones with different specific degrees of elasticity for containment.

A further aim of the present invention is to produce a garment with elastic inserts produced using circular machines which can be donned and removed quickly and easily.

A still further and not final aim of the present invention is to produce a garment with elastic inserts produced using circular machines which is easy to make and works well.

These aims and others besides, which will better emerge over the course of the present description, are essentially achieved by means of a garment with elastic inserts produced using circular machines, as outlined in the claims below.

Further characteristics and advantages will better emerge in the detailed description of a garment with elastic inserts produced using circular machines, according to the present invention, provided in the form of a non-limiting example, with reference to the accompanying drawings, in which:

DETAILED DESCRIPTION OF THE INVENTION

Figure 1:
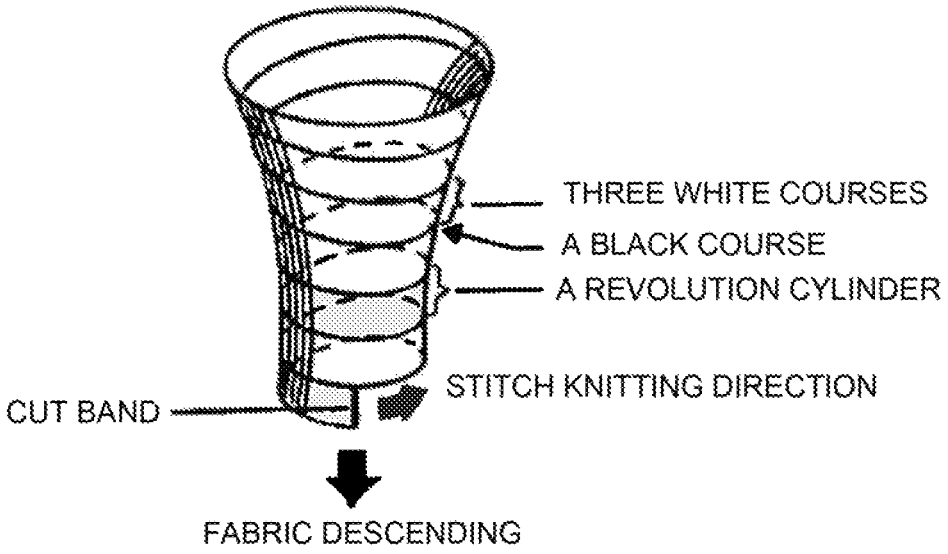
FIG. 1 shows a diagram of the production of the knitting on a circular machine.

With reference to the aforesaid figures, 1 is used to denote, as a whole, a garment with elastic inserts produced using circular machines according to the present invention.

As shown in FIGS. 2A, 2B, 2C, and 2D and in FIGS. 3A, 3B, 3C, and 3D, the garment 1 in question is a sock which features and is configured like a conventional sock with a toe 20, a conventional heel 21, a part 22 which wraps around the foot, a part 23 which wraps around the ankle and the leg, and an elasticised edge 24 envisaged to adhere to the user's leg so as to ensure the garment does not slide down the aforesaid leg.

The sock produced according to the present invention features elasticised sectors 3 obtained by working in a further elastomeric yarn—in addition to the ground yarn and the reinforcing yarn normally used—and actually knitting the yarns. This way, machining portions are created in both a horizontal and an oblique direction, giving origin to well defined and demarcated zones, as shown, for example, in FIG. 2B, which provide greater compression with respect to the knitting on the same row.

More specifically, within the elasticised sectors 3, there is a higher compression rate with respect to the exterior of the sector on the same row of knitting.

Figure 2A:
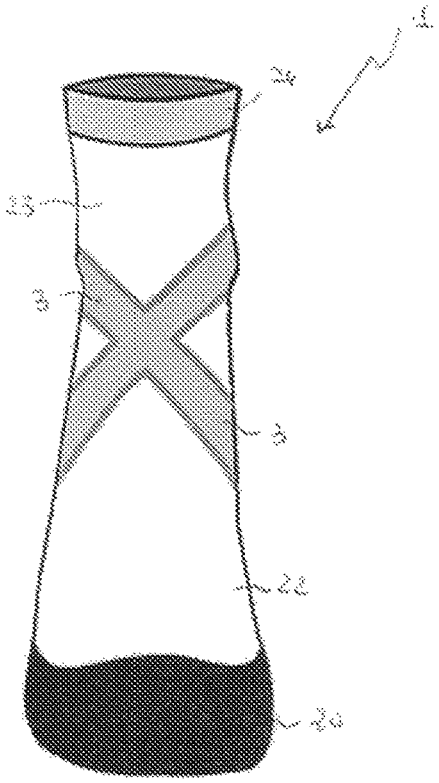
FIGS. 2A, 2B, 2C, and 2D, show, schematically, a garment with elastic inserts produced using circular machines according to the present invention.
Figure 2B:
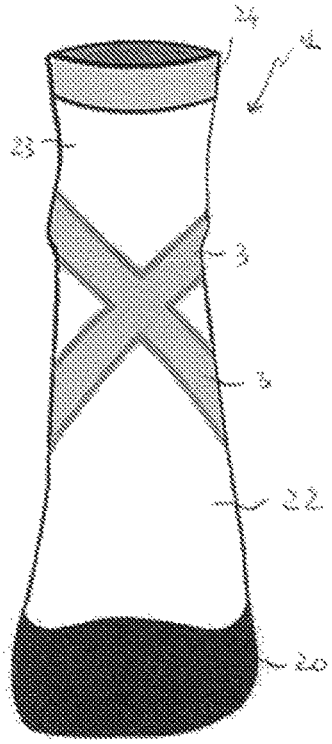
Figure 2C:
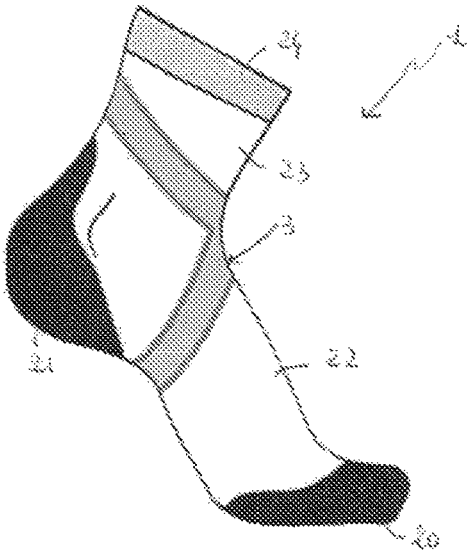
Figure 3A:
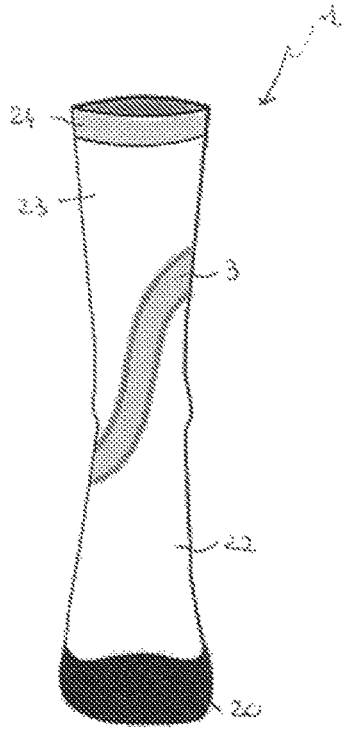
FIGS. 3A, 3B, 3C, and 3D, show, schematically, a variant of the garment in FIG. 2.
Figure 3B:
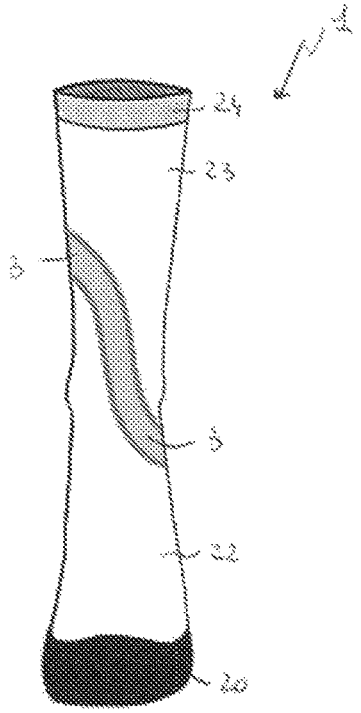
Figure 3C:
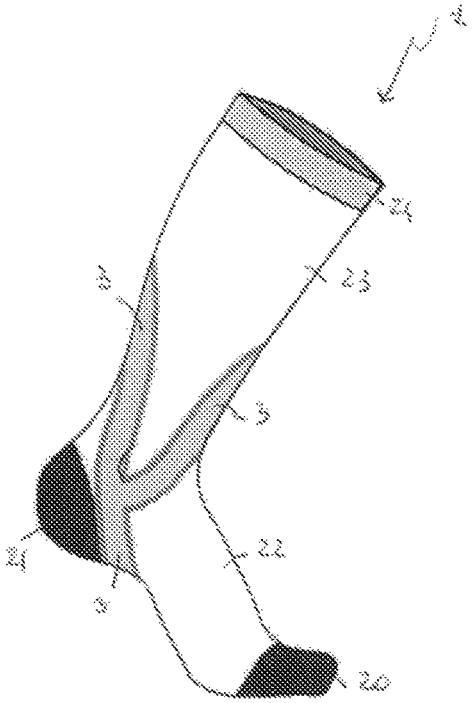
Figure 3D:
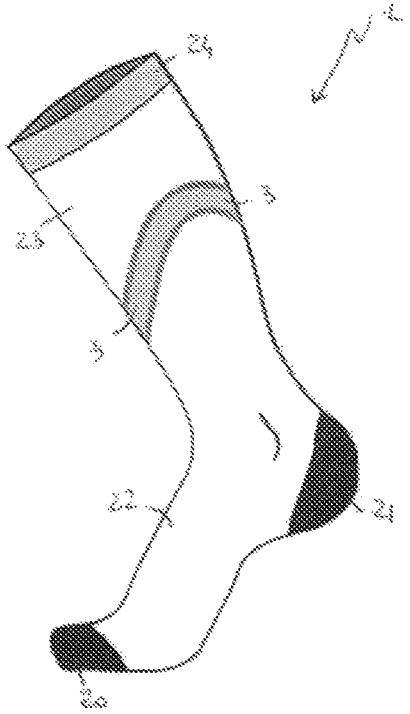

Such elasticised sectors 3 are designed and create ornamental figures or banding with specific compression which can contribute to the stimulation of blood circulation when properly positioned and sized, such as, for example, when they are placed around the ankle bone and straddling the neck of the foot, as shown in FIGS. 2A and 2C or stretching up to the calf, as in FIGS. 3A and 3C. In this case, the elasticised sector has a conformation reminiscent of a Y, which is used to stabilise the ankle bone joint, contributing to the stimulation of the calf, and when the muscle is under tension, such sector provides support which reduces the sensation of fatigue, in addition to reducing strain.

Figure 2D:
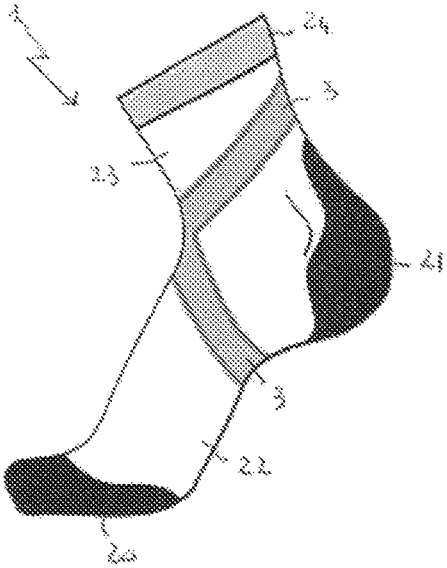

In accordance with the present invention, a further elasticised sector 3 is located over the neck of the foot (with an extension towards the ankle on one side and towards the forefoot on the other), wrapping it, as shown in FIGS. 2B and 2D. The elasticised sector just illustrated is designed to contain the joint of the neck of the foot, thereby controlling the type of movement possible.

As shown in FIGS. 2C and 2D, a still further sector 3 is placed under the foot, at the arch thereof, and running up to the inner ankle with an essentially "bean-like" shape, which is designed to support the arch of the foot, thereby providing a feeling of comfort and containment of the foot, in order to stimulate blood circulation while also providing support. Furthermore, the sectors 3 provide external protection for parts of the foot and/or leg against blows caused by falling or by rubbing, thereby providing a cushioning effect. Such protection is particularly recommended in sports socks, to protect the ankle bones or joints or muscles—for example, of a skier—but also in work socks for those who are always on the move.

In particular, the elasticised sectors 3 produce an effective massage effect which offers the user a feeling of comfort since movement is made safer and more supported.

In addition to everything illustrated so far, the presence of the elasticised sectors 3 in the sock allows the creation and insertion of appropriate elastic bands or stretches with different specific degrees of elasticity for containment, which allow lines of tension to be created and supported which perform a lymphatic massage which stimulates the musculature, therefore benefits can be obtained with regard to muscle or tendon fatigue.

As mentioned above, the elasticised sectors 3 are obtained by inserting an elasticised yarn during the formation of the knitting, or by inserting the yarn when one intends to start creating the elasticised sector and working the elastic yarn in with the ground yarn, starting the knitting of the elastic yarn by forming a row of knitting at a given point of one round and knitting a given number of stitches, depending on the desired width; the elastic yarn is then cut and secured by knitting such yarn in with other binding yarns, which are used separately from the ground yarn to secure the stitches and are present at both the beginning of the machining with the elastomeric yarn and the end of the line in the sector. On the next round, at the predetermined point, the elastic yarn is taken up again and worked for the number of stitches established in the design and can be equal to the number of stitches in the previous row, or higher or lower in number, depending on the shape of the sector one wishes to produce. The machining then continues as described for as many rounds as necessary in order to reach the height and the shape of the sector to be produced.

In more detail, during machining with a circular motion, the elastic yarn is machined together with the binding yarns for a given number of stitches, and when the portion is complete, the elastic yarn is once again joined with another yarn, which is used to bind and secure such the former yarn, i.e. the yarn is knitted in for a given number of stitches which varies depending on the desired design to be produced. The elastic yarn is then cut and brought back to the starting point by the yarn guide, ready for the next round of knitting. The operation for the knitting and binding of the elastic yarn with another yarn used in the machining allows a contour/profile to be created which "frames" the elasticised sector 3. In particular, the binding yarn creating the contour/profile may be highlighted if one produces a decorative design inside the sector or is less apparent if the sector is produced using a yarn with the same colour.

Figure 4A:
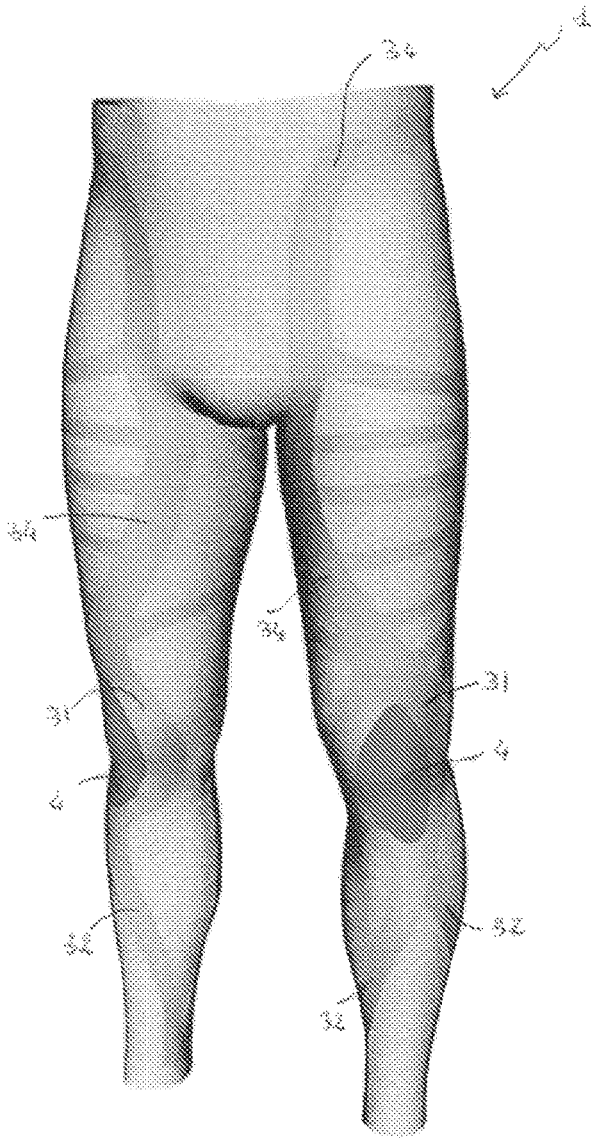
FIGS. 4A and 4B, show, schematically, respectively from a front view and a rear view, a different garment with elastic inserts according to present invention.
Figure 4B:
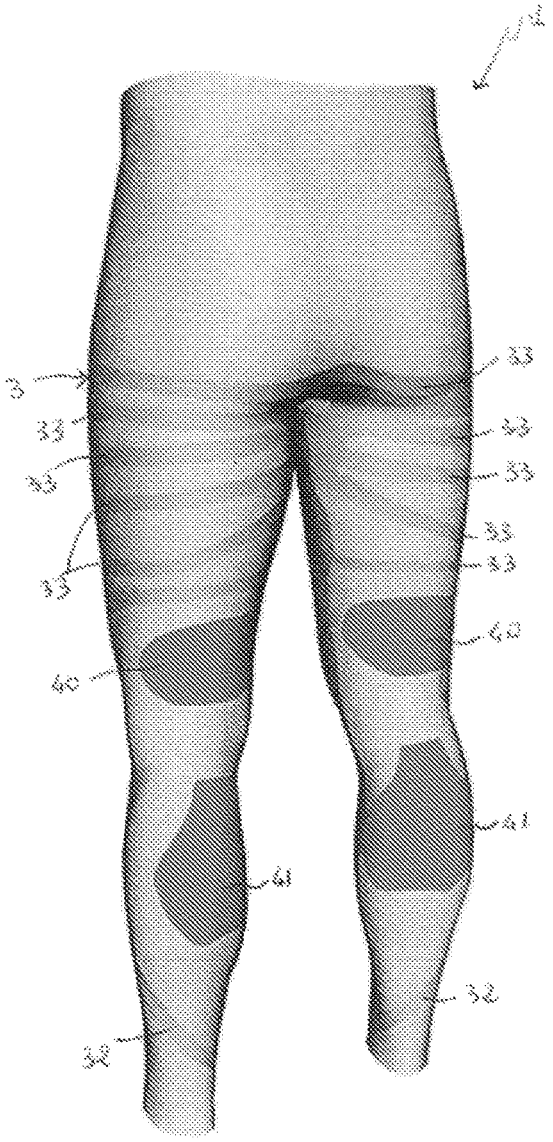

In accordance with the present invention, a further garment consists of trousers or leggings, as shown in FIGS. 4A and 4B.

The trousers 1 have elastic sectors located in different points and with particular configurations.

As shown in FIG. 4A, a first sector 31 is positioned so as to surround the kneecap to give a sense of grip, and therefore stability at the user's knee, alleviating strain on the ligaments, containing the muscles, and providing a sense of protection. From such sector, bands 32 branch off and, running around the leg, support the calf, following the same principle and conformation as described earlier for socks.

Furthermore, and also in the knee zone, there is a zone 4 endowed with less elastic compression, which is designed to help support the kneecap and distribute the compression over the kneecap tendon.

The trousers feature a second elasticised zone 40, located at the biceps femoris muscle of the thigh, which is endowed with a particular weave designed to support and massage such muscle.

A further zone 41 features less elastic compression and exerts action on the twin muscle of the calf, thereby providing support and performing a massage action.

In addition to everything illustrated so far, the trousers feature a rear sector 33 composed of a multitude of appropriately distributed bands, as shown in FIG. 4B, whose task is to support the gluteus, performing a lymphatic massage action.

Such arrangement of bands—by stimulating microcirculation—promotes not only circulation of the lymphatic system, but also faster metabolic exchange, thereby reducing fatigue and the production of lactic acid and improving both sporting performance and endurance.

Returning to the knee sector 31, from here a band 34 running towards the groin is designed to hold the thigh, groin and up to the abdominal muscles, providing support, compression, and stability, with a configuration that runs around the thigh, protecting both the quadriceps and the adductor muscles, which are normally more susceptible to traumas.

Figure 5A:
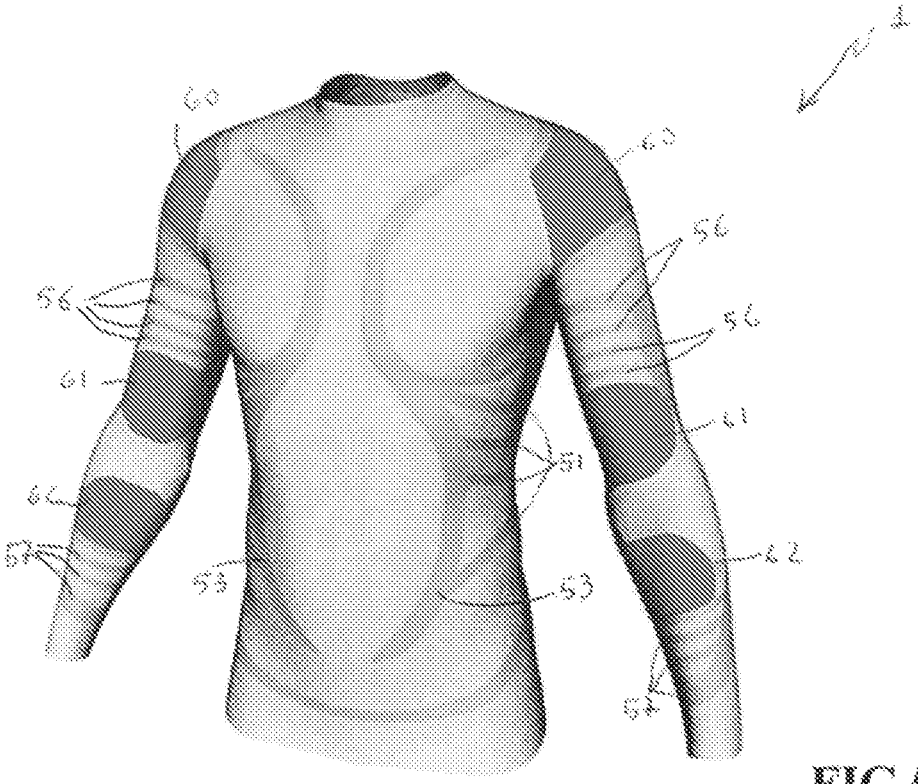
FIGS. 5A and 5B, show, schematically, respectively from a front view and a rear view, a further garment with elastic inserts.
Figure 5B:
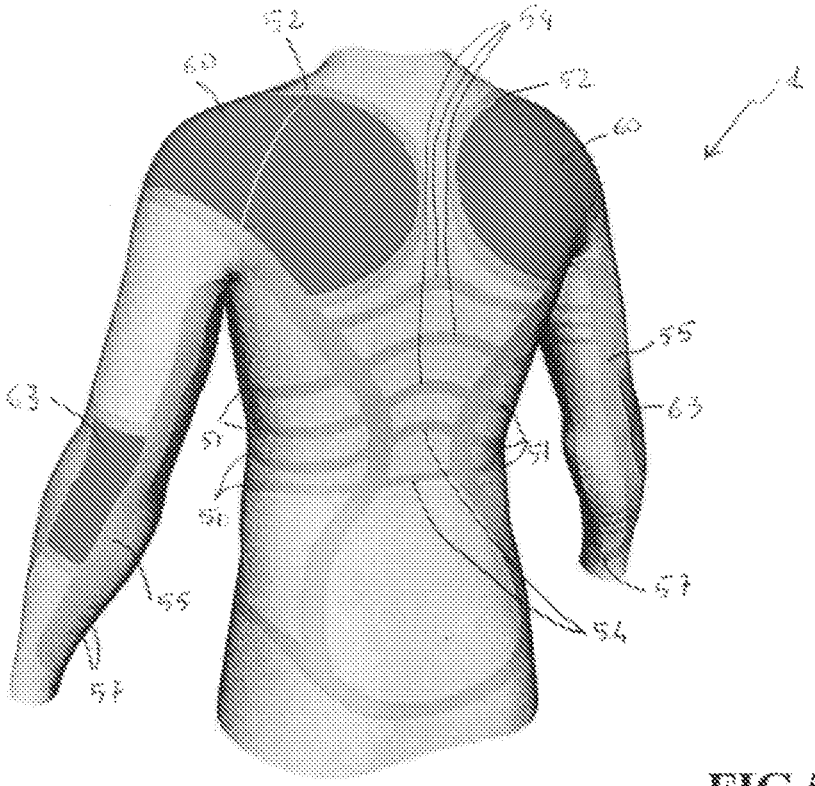

A further garment which is produced according to the present invention is a top, as shown in FIGS. 5A and 5B, which features elasticised sectors 5, which are arranged in such a configuration as to contain and support the various muscle masses, fully respecting the biomechanical function thereof.

A first sector features a series of bands 51 which are located on the side and run around the kidneys, then up towards the shoulder blades, and provide support for the oblique chest muscles, acting in synergy with an abdominal band 53 in order to provide stability for the abdominal portion and support for the spine.

In addition, the bands 52 around the shoulder and the shoulder blade promote perfect scapulohumeral rhythm.

Furthermore, a series of bands 54 are located in correspondence with the spine and are designed to provide support therefor and ensure symmetry of the muscular action between the two halves of the body, The top envisages a further elasticised sector located on the arms wherein a longitudinal band 55 runs along the rear of the humero-ulnar axis from which perpendicular inserts 56 branch off, located in correspondence with the humeral biceps, as do further perpendicular inserts 57 located on the forearm muscles.

The said bands have the task of helping to balance the action of agonist and antagonist muscles of the front and rear socket of the entire upper limb. More specifically, the bands 56 and 57 make it possible to reduce muscle fatigue during muscle contraction.

One variant envisages the presence of a band which covers the shoulder, the shoulder blade, and the pectoral muscle.

Furthermore, the top envisages elasticised zones 60, 61, 62, and 63 having a particular weave with less compression than the elasticised sectors.

Everything illustrated so far consist of embodiments, but with the same concept other configurations of bands and elasticised areas can be created, also located in different positions and designed to support and protect other muscles used, for example, in other sports activities or other types of work/effort/movement.

After the predominantly structural description, the invention in question will now be outlined.

When a user intends to carry out sports activities or a worker performs a series of repetitive movements which require effort, such user must simply wear one or more of the garments according to the present invention to be helped and supported, as well as protected, during the various movements and efforts.

Thus the present invention achieves the objects set.

The garment with elastic inserts produced using circular machines in question features a predefined, contoured, elasticised sector which contains a stretch of elastomeric yarn in an oblique direction, as well as horizontally, or with configurations of any shape and size, to create zones able to provide support and/or pinpointed compression.

Advantageously, the garment according to the present invention adapts perfectly to the body's morphology without an uncomfortable thickness and features precise stretches of greater compression with respect to the knitting present on the same row.

Furthermore, the garment with elastic allows user to obtain stimulation of the blood circulation, a massaging effect, optimal support, and also remarkable comfort when worn.

In addition, the garment with elastic inserts can have elastic bands or elastic zones with different specific degrees of elasticity for containment inside the same sector, both vertically and horizontally or with a variable configuration.

A further advantage offered by the garment in question is that such garment can be donned and removed quickly and easily.

Advantageously, the garment according to the present invention enables a considerable reduction of the mechanical stress to the user's skin, bones, muscles and tendons, in addition to preventing contusions of both the muscles and the tendons.

In addition, the garment is donned and removed easily and quickly, offering comfort and protection without being particularly constrictive (as used to occur, for example, with the socks according to the previously known technique, in which the elastic yarn was present throughout the weave, proving particularly constrictive) and preventing unsightly bulky bulges (as occurs with the toweling inserts present in the socks according to the commonly known technique).

The garment in question allows an innovative effect to be achieved since an elastic yarn can be worked into the predetermined portions in such a way that the fabric obtained is correctly gauged, with a suitable setting which allows the desired grip to be achieved. In fact, it is not possible to produce the same fabric (as that produced following changes to the circular machine processing) by simply inserting an elastic yarn.

One advantage achieved with the present garment is that the user's performance improves since the disturbing, uncomfortable elements are reduced, making the user much safer during the movements and efforts thereof.

In particular, by reducing the stress factors, the condition after the sports activity is also improved, helping users recover their physical fitness more quickly.

One of the advantages offered by such garment is undoubtedly that of being wearable with any clothing, therefore a new way of dressing may arise herefrom as the constituent knitted fabric is flat and thin so such garment is not noticeable underneath one's clothes.

A further advantage is due to the fact that the garment in question is easy to manufacture and works well.

Naturally, further modifications or variants may be applied to the present invention while remaining within the scope of the invention that characterises it.

The invention claimed is:

1. A garment with elastic inserts produced using a circular machine, wherein the garment is formed by knitting a ground yarn and a reinforcing yarn together around a circumference so as to form a vertical succession of rows of knitted stitches, each row of knitted stitches extending in a horizontal direction, wherein the elastic inserts include elasticized sectors obtained by knitting an elastomeric yarn together with the ground yarn and the reinforcing yarn so as to create elasticized knitted stitches which form a pattern extending in the horizontal direction and in an oblique direction relative to the horizontal direction, which results in demarcated elasticized zones in which elasticized knitted stitches of one of the rows provide greater compression than the knitted stitches of a same one of the rows, such that within the elasticized sectors, elasticized knitted stitches of each row provide a greater compression value than knitted stitches outside the elasticized sectors on a corresponding same row of knitted stitches.

2. The garment with elastic inserts according to claim 1, wherein the elasticized zones have a pattern configured to support and massage a muscle in contact therewith when worn by a user.

3. The garment with elastic inserts according to claim 1, wherein the elasticized sectors and elasticized zones form sections of knitted fabric with different degrees of elasticity and specific degrees of compression, which provide support and create lines/portions of tension configured to perform a lymphatic massage action which stimulates muscles of a user when worn.

4. The garment with elastic inserts according to claim 1, wherein the garment is a sock, and wherein the elasticized sectors include at least one of:

a first elasticized sector configured to extend around an ankle bone of a user and over a neck of a foot of the user, or stretching up to a calf of the user with a shape reminiscent of a Y, the first elasticized sector being further configured to stabilize an ankle bone joint, contribute to stimulation of the calf, and when the calf is under tension, to provide support which reduces a sensation of fatigue and reduces strain;

a second elasticized sector located over the neck of the foot of the user with an extension towards the ankle on one side and towards a forefoot on the other side, which wraps around the foot and is configured to contain a joint of the neck of the foot, thereby controlling a type of movement possible; and a third elasticized sector arranged under the foot of the user, at an arch thereof, and running up to an inner ankle, the third elasticized sector being configured to support the arch of the foot, thereby providing a feeling of comfort and compression of the foot, in order to stimulate blood circulation while also providing support.

5. The garment with elastic inserts according to claim 4, wherein the elasticized sectors provide external protection for parts of the foot or leg of the user against blows caused by falling or by rubbing, thereby providing a cushioning effect.

6. The garment with elastic inserts according to claim 1, wherein the garment is a pair of leggings, and wherein the elasticized sectors include:

a first elasticized sector, which surrounds a kneecap of the user, and is configured to give the user a sense of firmness, stability, and protection for the knee, thereby alleviating strain on ligaments and containing muscles;

first bands branching off from the first elasticized sector which run around a leg of the user in order to support a calf of the user;

a second band, which runs from the first elasticized sector up towards a groin of the user, which is configured to hold a thigh and the groin, up to abdominal muscles of the user, so as to provide support, compression, and stability, and which is configured to run around the thigh so as to protect both quadriceps and adductor muscles of the user; and a rear sector composed of a multitude of third bands, the third bands being configured to support a gluteus of the user, perform a lymphatic massaging action, and by stimulating microcirculation, to promote not only circulation of a lymphatic system of the user, but also faster metabolic exchange, thereby reducing fatigue and production of lactic acid.

7. The garment with elastic inserts according to claim 6, wherein the pair of leggings further comprises:

in an inner portion of the first elasticized sector, a first elasticized zone endowed with less elastic compression than a surrounding portion of the first elasticized sector, the first zone being configured to help support the kneecap and distribute compression over a kneecap tendon;

a second elasticized zone, located at a biceps femoris muscle of the thigh, which is endowed with a pattern configured to support and massage the biceps femoris muscle; and a third elasticized zone, which is endowed with less elastic compression and is configured to exert action on a twin muscle of the calf, thereby providing support and performing a massage action.

8. The garment with elastic inserts according to claim 1, wherein the garment is a top, wherein the elasticized sectors include:

a first elasticized sector having a series of first bands which are located on a side and run around kidneys of a user and up towards shoulder blades of the user in order to provide support for oblique chest muscles of the user, and which are configured to act in synergy with an abdominal band in order to provide stability for an abdominal portion and support for a spine of the user;

a second elasticized sector having a series of second bands running around a shoulder of the user and a corresponding one of the shoulder blades so as to promote scapulohumeral rhythm;

a third elasticized sector comprising a series of third bands, which are located in correspondence with the spine and are configured to provide support therefor and ensure symmetry of muscular action between two halves of a body of the user; and fourth elasticized sectors located on arms of the user, respectively, wherein each fourth elasticized sector has a longitudinal band running along a rear of a humero-ulnar axis from which perpendicular inserts branch off, located in correspondence with humeral biceps of the user, as do further perpendicular inserts located on the forearm muscles, each longitudinal band being configured to balance an action of agonist and antagonist muscles of front and rear sockets of an entire upper limb.

9. The garment with elastic inserts according to claim 8, further comprising elasticized zones having a pattern with less compression than the elasticized sectors and configured to support and protect muscular areas.

10. A process for the production of elasticized sectors in the garment according to claim 1, the process including:

knitting the ground yarn and the reinforcing yarn together;

inserting an elasticized yarn during the knitting, or by inserting the elasticized yarn to start creating one of the elasticized sectors and working the elasticized yarn in with the ground yarn, starting the knitting of the elasticized yarn by forming a row of knitting at a given point of one round and knitting a given number of stitches;

cutting and securing the elasticized yarn by knitting the elasticized yarn in with other binding yarns, which are used separately from the ground yarn to secure the stitches and are present at both a beginning of knitting with the elastomeric yarn and an end of the elasticized sector;

bringing the elasticized yarn back to a starting point of the elasticized sector by a yarn guide so as to be ready for subsequent use in a following round of knitting; and in the following round, at the given point, the picking up the elasticized yarn and then knitting a number of stitches envisaged on the pattern, and performing subsequent rounds of knitting for as many rounds as are needed to obtain a desired height and shape of the elasticized sector to be produced.

11. The process for the production of elasticized sectors according to claim 10, wherein during knitting, the elasticized yarn is knitted together with the reinforcing yarn for a given number of stitches, at both a beginning of the elasticized sector and the end of the elasticized sector, on each row, the reinforcing yarn being configured to bind and secure the elasticized yarn, knitting the elasticized yarn in for a given number of stitches.

12. The process for the production of elasticized sectors according to claim 10, wherein during the knitting of the elasticized yarn with the ground yarn and the reinforcing yarn, a contour/profile is created which "frames" the elasticized sector.

* * * * *